US009670761B2

(12) United States Patent
Hytken

(10) Patent No.: US 9,670,761 B2
(45) **Date of Patent: *Jun. 6, 2017**

(54) METHODS AND SYSTEMS FOR DOWNHOLE THERMAL ENERGY FOR VERTICAL WELLBORES

(71) Applicant: Future Energy, LLC, Dayton, OH (US)

(72) Inventor: Kent B. Hytken, San Diego, CA (US)

(73) Assignee: Future Energy, LLC, Dayton, OH (US)

( * ) Notice: Subject to any disclaimer, the term of this patent is extended or adjusted under 35 U.S.C. 154(b) by 256 days.

This patent is subject to a terminal disclaimer.

(21) Appl. No.: 14/385,607

(22) PCT Filed: Mar. 14, 2013

(86) PCT No.: PCT/US2013/031256

§ 371 (c)(1),
(2) Date: Sep. 16, 2014

(87) PCT Pub. No.: WO2013/142242

PCT Pub. Date: Sep. 26, 2013

(65) Prior Publication Data

US 2015/0041128 A1 Feb. 12, 2015

Related U.S. Application Data

(60) Provisional application No. 61/613,858, filed on Mar. 21, 2012.

(51) Int. Cl.
*E21B 37/06* (2006.01)
*E21B 43/24* (2006.01)
(Continued)

(52) U.S. Cl.
CPC ..... *E21B 43/2406* (2013.01); *E21B 36/00* (2013.01); *E21B 37/06* (2013.01); *E21B 43/126* (2013.01); *E21B 43/128* (2013.01)

(58) Field of Classification Search
None
See application file for complete search history.

(56) References Cited

U.S. PATENT DOCUMENTS 2,634,961 A 4/1953 Ljungstrom
2,732,195 A 1/1956 Ljungstrom
(Continued)

OTHER PUBLICATIONS

MSDS Calcium Chloride, retrieved Jul. 22, 2016.*
MSDS Sodium Chloride, retrieved Jul. 22, 2016.*
International Preliminary Report on Patentability completed Jun. 17, 2013 pertaining to International Application No. PCT/US2013/031256.

(Continued)

*Primary Examiner* — Angela M DiTrani
(74) *Attorney, Agent, or Firm* — Dinsmore & Shohl LLP

(57) ABSTRACT

Systems and methods for enhanced delivery of thermal energy to vertical wellbores are disclosed. In one embodiment, a method comprises heating a heat transfer fluid; continuously circulating the heat transfer fluid into a vertical wellbore to a downhole heat exchanger; advancing hot feedwater into the vertical wellbore to the downhole heat exchanger, wherein the downhole heat exchanger is configured to transfer heat from the heat transfer fluid to the hot feedwater to generate high-quality steam; transmitting the steam from the downhole heat exchanger into a subterranean formation, whereby thermal energy from the steam causes a reduction in viscosity of hydrocarbons in the subterranean formation; injecting an acid scale wash to counter scale buildup from the hot feedwater on the downhole heat exchanger; and returning the heat transfer fluid from the downhole heat exchanger to the surface thermal fluid heater for reheating and recirculation into the vertical wellbore.

17 Claims, 6 Drawing Sheets

(51) Int. Cl.
*E21B 36/00* (2006.01)
*E21B 43/12* (2006.01)

(56) References Cited

U.S. PATENT DOCUMENTS

| | | | | | |
|---|---|---|---|---|---|
| 2,780,450 | A | | 2/1957 | Ljungstrom | |
| 2,789,805 | A | | 4/1957 | Ljungstrom | |
| 2,923,535 | A | | 2/1960 | Ljungstrom | |
| 4,344,485 | A | | 8/1982 | Butler | |
| 4,641,710 | A | * | 2/1987 | Klinger | E21B 36/00 166/266 |
| 4,886,118 | A | | 12/1989 | Van Meurs et al. | |
| 5,085,275 | A | * | 2/1992 | Gondouin | E21B 36/00 166/266 |
| 5,816,325 | A | * | 10/1998 | Hytken | E21B 36/00 166/303 |
| 7,832,482 | B2 | | 11/2010 | Cavender et al. | |
| 8,955,591 | B1 | * | 2/2015 | Hytken | 166/302 |
| 9,200,505 | B2 | * | 12/2015 | Hytken | E21B 43/24 |
| 2008/0083536 | A1 | | 4/2008 | Cavender et al. | |
| 2009/0008090 | A1 | | 1/2009 | Schultz et al. | |
| 2009/0166032 | A1 | * | 7/2009 | Carr, Sr. | E21B 36/005 166/250.01 |

OTHER PUBLICATIONS

International Search Report and Written Opinion completed Jun. 17, 2013 pertaining to International Application No. PCT/US2013/031256.

* cited by examiner

METHODS AND SYSTEMS FOR DOWNHOLE THERMAL ENERGY FOR VERTICAL WELLBORES

BACKGROUND OF THE INVENTION

The present invention relates generally to methods and systems for production of hydrocarbons from various subsurface subterranean formations. The present invention, downhole steam injection, is a novel approach to a very successful application of surface steam injection into heavy oil reservoirs that began in the late 1950's. Today, steam injection is also used in light oil formations to increase recovery of residual oil after depletion of reservoir pressure. Pressurized steam can add new pressure to the light oil subterranean deposit while the steam melts the oil off the rock the steam condenses to water and the water will act as a drive mechanism to push the oil through the reservoir to the production wells.

SUMMARY OF THE INVENTION

Various embodiments of the present invention provide for improved delivery of downhole thermal energy, or heat and steam, to increase the efficiency of recovery of hydrocarbons from a subsurface subterranean formation.

In one aspect, a method comprises heating a heat transfer fluid; circulating the heat transfer fluid into a vertical wellbore to a downhole heat exchanger positioned in a steam chamber near the bottom of the vertical wellbore; advancing hot feedwater into the vertical wellbore to the downhole heat exchanger, wherein the downhole heat exchanger is configured to transfer heat from the heat transfer fluid to the hot feedwater to generate high quality steam; transmitting the steam from the downhole heat exchanger into a subterranean formation, whereby thermal energy from the high quality steam causes a reduction in viscosity of hydrocarbons in the subterranean formation; injecting an acid scale wash to remove scale buildup on the downhole heat exchanger from the hot feedwater; and returning the heat transfer fluid from the downhole heat exchanger to the surface thermal fluid heater.

In another aspect, a system comprises a vertical wellbore; a downhole heat exchanger positioned at a downhole position near the bottom of the vertical wellbore; a heat transfer fluid loop system for continuously circulating heated heat transfer fluid into a vertical wellbore to the downhole heat exchanger; a feedwater system to provide feedwater into the vertical wellbore to the downhole heat exchanger; and an acid scale wash system to inject an acid scale wash to counteract scale buildup on the downhole heat exchanger from the feedwater; wherein the downhole heat exchanger is configured to transfer heat from the heated heat transfer fluid to the feedwater to generate high-quality steam; wherein the steam is transmitted from the downhole heat exchanger into a subterranean formation, whereby thermal energy from the high-quality steam causes a substantial reduction in viscosity of hydrocarbons in the subterranean formation; and wherein the heat transfer fluid loop system is configured to return the heat transfer fluid from the downhole heat exchanger to the surface thermal fluid heater where it is to be reheated.

In another aspect, a method comprises heating a heat transfer fluid; continuously circulating the heat transfer fluid into a vertical wellbore to a downhole heat exchanger; transferring thermal energy from the heat transfer fluid to a subterranean formation through a downhole heat exchanger, whereby thermal energy transferred to the subterranean formation causes a reduction in viscosity of hydrocarbons in the subterranean formation; returning the heat transfer fluid from the downhole heat exchanger to the surface thermal fluid heater to be reheated; and recovering liquefied hydrocarbons using an electrical submersible pump (ESP) or sucker rod including a sump pump positioned near the bottom of the vertical wellbore.

In another aspect, a system comprises a vertical wellbore; a downhole heat exchanger positioned at a downhole position of the vertical wellbore; a heat transfer fluid loop system for continuously circulating heated heat transfer fluid into a vertical wellbore to the downhole heat exchanger; and an electrical submersible pump (ESP) or a sucker rod configured to recover liquefied hydrocarbons positioned near the bottom of the vertical wellbore, wherein the downhole heat exchanger is configured to transfer thermal energy from the heated heat transfer fluid to a subterranean formation, whereby thermal energy transferred to the subterranean formation causes a reduction in viscosity of hydrocarbons in the subterranean formation; and wherein the heat transfer fluid loop system is configured to return the heat transfer fluid from the downhole heat exchanger to the surface thermal fluid heater to be reheated. The use of a sucker rod or electrical submersible pump (ESP) may result in a cyclic action referred to as cyclic steam stimulation or "huff and puff".

In another aspect, a method comprises heating a heat transfer fluid; continuously circulating the heat transfer fluid into a vertical wellbore to a downhole heat exchanger; transferring thermal energy from the heat transfer fluid to a subterranean formation through a downhole heat exchanger, whereby thermal energy transferred to the subterranean formation causes a reduction in viscosity of hydrocarbons in the subterranean formation; returning the heat transfer fluid from the downhole heat exchanger to the surface thermal fluid heater to be reheated; and recovering liquefied oil deposits from gravity drainage into a horizontal wellbore and pumping the liquefied oil deposits to the surface through a production line with the assistance of sucker rod or electrical submersible pump (ESP).

Figure 1:
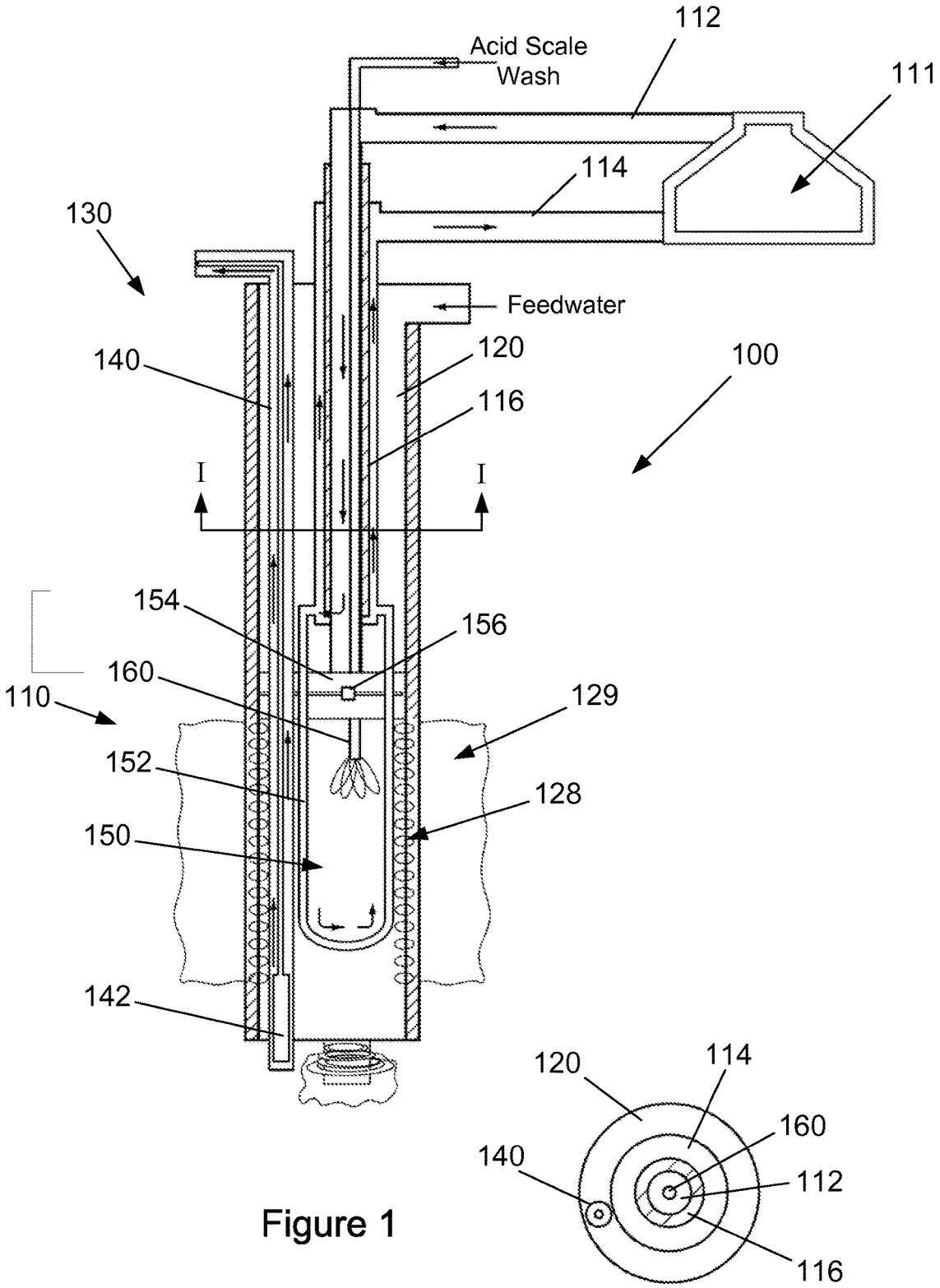
FIG. 1 is a schematic illustration of a vertical wellbore with a downhole heat exchanger in accordance with an embodiment.

While the invention is susceptible to various modifications and alternative forms, specific embodiments thereof are shown by way of example in the drawings and may herein be described in detail. The drawings are not to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

The total estimated amount of oil in an oil reservoir, including both producible and non-producible oil, is called oil-in-place. However, because of reservoir characteristics and limitations in petroleum extraction technologies, only a fraction of this oil can be brought to the surface, and it is only this producible fraction that is considered to be proved reserves. The ratio of producible oil reserves to total oil-in-place for a given field is often referred to as the recovery factor. Recovery factors vary greatly among oil fields. The recovery factor of any particular field may change over time based on operating history and in response to changes in technology and economics. The recovery factor may also rise over time if additional investment is made in enhanced oil recovery (EOR) techniques such as steam injection, CO2 injection, surfactants injection, water-flooding, microbial enhanced oil recovery or other EOR applications.

The present invention can provide high quality steam to the subterranean deposits combined with other methods that will enhance the deposits. Some of the methods could be heated solvents, heated gas and surfactants.

Surfactants are compounds that lower the surface tension of a liquid, the interfacial tension between two liquids, or that between a liquid and a solid. Surfactants may act as wetting agents, emulsifiers, foaming agents, and dispersants. Surfactants are usually organic compounds that are amphiphilic, meaning they contain both hydrophobic groups and hydrophilic groups. Therefore, a surfactant molecule contains both a water insoluble (and oil soluble) component and a water soluble component. Surfactant molecules will diffuse in water and adsorb at interfaces between air and water or at the interface between oil and water, in the case where water is mixed with oil.

Surfactants and solvents combined with downhole steam injection have the potential to significantly increase oil recovery over that of conventional water flooding. The availability of a large number of surfactant structures makes it possible to conduct a systematic study of the relation between surfactant structure and its efficacy for oil recovery. Also, the addition of an alkali such as sodium carbonate makes possible in-situ generation of surfactant and significant reduction of surfactant adsorption. In addition to reduction of interfacial tension to ultra-low values, surfactants and alkali can be designed to alter wettability followed by steam injection to enhance oil recovery.

An alkaline surfactant process is designed to enhance spontaneous imbibitions in fractured, oil-wet, carbonate formations. Mobility control is essential for steam-surfactant EOR to improve the sweep efficiency of surfactant and steam injected into fractured reservoirs.

Concerns over depletion of available and easy to find light hydrocarbon resources has led to development of processes for more efficient recovery of available unconventional hydrocarbon resources. In Situ petroleum production processes may be used to remove hydrocarbons from subterranean formations. In Situ refers to in-ground oil recovery techniques which apply heat, steam or solvents into a subterranean formation. Chemical and/or physical properties of hydrocarbon material in a subterranean formation need to be changed to allow the hydrocarbons to be more easily removed from the subterranean formation. The chemical and physical changes may include In Situ processes that produce removable fluids, composition changes, solubility changes, density changes, phase changes, and/or viscosity changes of the hydrocarbon material in the subterranean formation. A heat transfer fluid may be, but is not limited to, a gas, oil, water, molten salt, a noncorrosive fluid employing either liquid phase or vapor phase heating, an emulsion, slurry, and/or a stream of solid particles, chemicals and heated solvents that has flow characteristics similar to liquid flow.

In some embodiments, an expandable tubular may be used in a wellbore. Expandable tubulars are described in, for example, U.S. Pat. No. 5,366,012 to Lohbeck and U.S. Pat. No. 6,354,373 to Vercaemer et al., each of which is incorporated by reference as if fully set forth herein.

Thermal fluid heaters may be placed in wellbores to heat a subterranean formation during an In Situ process. Examples of In Situ processes utilizing downhole thermal fluid heaters are illustrated in U.S. Pat. No. 2,634,961 to Ljungstrom; U.S. Pat. No. 2,732,195 to Ljungstrom; U.S. Pat. No. 2,780,450 to Ljungstrom; U.S. Pat. No. 2,789,805 to Ljungstrom; U.S. Pat. No. 2,923,535 to Ljungstrom; and U.S. Pat. No. 4,886,118 to Van Meurs et al.; each of which is incorporated by reference as if fully set forth herein.

Heat can be applied to the oil shale subterranean formation to pyrolyze kerogen in the oil shale subterranean formation. The heat may also fracture the subterranean formation to increase permeability of the subterranean formation. The increased permeability may allow subterranean formation fluid, kerogen and natural gas, to travel to a production well where the fluid is removed from the oil shale subterranean formation. Enhanced heat and high quality high pressure steam injection can be applied to low permeability subterranean formations such as a diatomite, oil shale, tight oil such as shale oil, and shale gas to thermally fracture the subterranean formation to increase permeability of the subterranean formation allowing better steam injection, conductive and convective heat injection thus increasing the oil production and oil recovery.

A heat source can be used to heat heavy oil, oil sands, oil shale, tight oil such as shale oil, or any other subterranean formation. Downhole heaters can be used to heat the subterranean formation by steam, convection or conduction. In what could lead to one of the most revolutionary innovations in the history of the oil industry, this technology has a way to upgrade bitumen, shale oil, tight oil and heavy oil in the reservoir. Continuous circulation of molten salt or a synthetic non-corrosive heated working fluid in a downhole coiled tubing or other tubing configuration acts as a conductive or high quality steam heating process that will raise the subsurface temperature to the point where the reservoir, in effect, acts as a refinery. The oil product is as mobile as water. Conductive heat or high quality steam with diluents acts as a refinery and produces light oil products or synthetic crude leaving the coke remains in the subsurface and this will achieve more oil recovered that is a high quality product. This will lead to better composition of the upgraded product, and better recovery efficiency. As happens in a refinery, the lighter products are boiled off, leaving the heavier components behind. The upgraded oil can be further refined into products such as gasoline and jet fuel. Refining in the reservoir would indeed be a major technological development. Bitumen upgrading is now done inside specially built steel vessels where temperatures, pressures and other conditions can be strictly controlled. To achieve this upgrading in the subsurface, the reservoir serves as a gigantic vessel that can allow much lower reaction rates. The in-ground vessel is much larger and you can let it go for a year rather than a minute throughput in a refinery where you need to have a certain throughput through a vessel, and that drives a certain reaction rate; otherwise, you just don't have enough productivity.

The downhole heating element generates convective, conductive or radiant energy that heats the casing. A granular solid fill material may be placed between the casing and the subterranean formation. The casing may conductively heat the fill material, such as a gas, which in turn conductively heats the subterranean formation. In some examples, steam is used to heat the fill material, which in turn may heat the subterranean formation. Steam can be generated downhole, as described in FIG. 1, for example. The wellbore casing may include vacuum insulated tubing. A gas drive with the desired pressure could be employed to effectively push the heat away from the wellbore and into the subterranean formation.

In typical conventional steam-assisted gravity drainage (SAGD) recovery of hydrocarbons from a subsurface subterranean formation, the steam is generated on the surface and transmitted to the horizontal wellbore. The loss in steam quality is due to the great distance the steam travels on the surface from the boiler to the injection wellbore, down the vertical injection wellbore, and then into the horizontal wellbore that can result in degradation of the steam quality through substantial heat loss. The most significant heat losses are in the vertical and horizontal wellbores. Thus, the surface steam that is delivered to the hydrocarbons in a subsurface subterranean formation, for example, may not be a high-quality steam. The degradation of the steam could condense to water in the second half of or two-thirds of 2,000 lineal foot horizontal wellbore, which will result to just a hot water flood, that will substantially reduce the hydrocarbons recovered from a subsurface subterranean formation. The consequences will be a higher steam-to-oil ratio and a less economical project.

Embodiments of the present invention are directed to various methods and systems for recovering petroleum resources using vertical and horizontal wellbores in geological subterranean formation strata from a vertical position. The geological structures intended to be penetrated in this fashion may be coal seams, uranium, methane hydrate, heavy and light hydrocarbons from a subsurface subterranean formation bearing strata for increasing the flow rate from a pre-existing wellbore. Other possible uses for the disclosed embodiments can be used for high pressure high quality steam injection for steam fracking of low permeability subterranean formations such as low gravity heavy oil, diatomite, tight oil, shale oil, shale gas, leaching of uranium ore and sulfur from underground subterranean formations or for introducing horizontal and vertical channels for steam injection, heated solvents, and chemicals, for example. Those skilled in the art will understand that the various embodiments disclosed herein may have other uses which are contemplated within the scope of the present invention.

Referring first to FIG. 1, a cross-sectional view of an embodiment of a downhole heat exchanger arrangement 100 in accordance with an embodiment of the present invention is illustrated. In accordance with the arrangement 100 of FIG. 1, wellbore heat losses resulting in lower quality steam is reduced through the use of a downhole heat exchange system 110.

In accordance with the embodiment illustrated in FIG. 1, the downhole heat exchange system 110 is positioned within a vertical wellbore 130. In various embodiments, the depth of the downhole heat exchanger will vary according to the depth of the subterranean formation. For example, in various embodiments, the depth of the vertical wellbore 130 may be between several hundred feet and 10,000 thousand feet or more.

In the embodiment of FIG. 1, the vertical wellbore 130 includes concentric tubing strings formed to allow various fluids to flow there through. Hot feedwater is injected into the vertical wellbore 130 downward through the casing annulus or the outermost concentric tubing string 120. The downhole heat exchange system 110 is configured to flash the hot feedwater into steam 129, and the high quality steam is directed into the hydrocarbons in a subsurface subterranean formation through, for example, perforations 128 in the wellbore 130. The perforations 128 are schematically illustrated in FIG. 1 near the bottom of the vertical wellbore 130. High quality steam is directed into the geologic strata around the vertical wellbore 130.

The high quality steam adds thermal energy to the hydrocarbons from a subsurface subterranean formation and serves to reduce the viscosity of the hydrocarbons from a subsurface subterranean formation deposit, causing the hydrocarbons from a subsurface subterranean formation to flow downward due to gravity drainage. The hydrocarbons from the subsurface subterranean formation are captured and brought to the surface through a sucker rod pump 140 or an electrical submersible pump (ESP) 142 and are transported to one or more tanks (not shown) on the surface. In this regard, an electrical submersible pump (ESP) 142 and/or a sucker rod 140 are provided at a point sufficiently deep to pump the flowing hydrocarbons to the surface. The electrical submersible pump (ESP) 142 and all electrical cabling necessary for operation and control of the electrical submersible pump (ESP) 142 are provided within a tubing string which can also include a sucker rod pump 140. In the illustrated embodiment, the tubing string forming the electrical submersible pump (ESP) 142 and sucker rod pump 140 may or may not be concentric with the other tubing strings in the downhole heat exchanger arrangement 100. Of course, those skilled in the art will recognize that the electrical submersible pump (ESP) 142 and sucker rod pump 140 may be positioned differently in different embodiments. The use of a sucker rod may result in a cyclic action referred to as cyclic steam stimulation or "huff and puff".

In the embodiment of FIG. 1, the wellbore 130 and the various tubing strings may be formed of insulated coiled tubing string or insulated threaded tubing string such as Macaroni insulated threaded tubing, Vacuum Insulated Tubing or THERMOCASE® insulated threaded tubing. Coiled tubing string is well known to those skilled in the art and refers generally to metal piping that is spooled on a large reel. Macaroni threading tubing is well known to those skilled in the art. THERMOCASE® insulated threaded tubing is well known to those skilled in the art. Coiled tubing, THERMOCASE® tubing and Macaroni threaded tubing may have a diameter of between about one inch to about 3.25 inches. Of course, those skilled in the art will understand that the various embodiments are not limited to coiled tubing and threaded tubing, or to any particular dimensions of the tubing.

Referring again to FIG. 1, a heated heat transfer fluid is delivered through a heat transfer fluid inlet tubing string 112. The heated heat transfer fluid is provided from the surface to a position within the wellbore. The heated heat transfer fluid is pumped and circulated through the heat transfer fluid inlet tubing string 112 at a very high flow rate to minimize loss of heat to the hot feedwater. In one embodiment, the heat transfer fluid inlet tubing string 112 is a tube having a diameter of approximately 0.75 inches or more. In other embodiments, the heat transfer fluid inlet tubing string 112 may be sized according to factors such as pump capability, distance between surface and the bottom of the vertical wellbore, and the type of heat transfer fluid, for example.

Additionally, hot feedwater is injected into the casing annulus or a separate outermost concentric tubing string 120. The hot feedwater may be injected as a super critical hot water temperature to maximize the thermal energy prior to conversion to steam being delivered to the hydrocarbons in the subsurface subterranean formation. In the illustrated embodiment, the hot feedwater tubing string 120 is the outermost tubing string in the concentric configuration or in the casing annulus.

At the downhole heat exchanger 110 shown in FIG. 1, inlet tubing string 112 connects to a downhole heat exchanger tubing string 152 within a steam chamber portion 150 of the downhole heat exchanger 110. The heat transfer fluid from the inlet tubing string 112 passes through downhole heat exchanger tubing. Heat from downhole heat exchanger tubing string 152 vaporizes the hot feedwater in the tubing string 120 within the steam chamber portion 150. After passing through downhole heat exchanger 110 and the downhole heat exchanger tubing string 152, return heat transfer fluid ascends back to the surface thermal fluid heater in the outlet tubing string 114.

A packer assembly 154 with a feed valve(s) 156 controls the rate of the hot feedwater that flashes into the downhole heat exchanger 152. In one embodiment, the feed valve(s) 156 responds to the pressure differences between the hot feedwater at the base of the hot feedwater tubing string 120 and the vapor pressure within the steam chamber portion 150 so that vapor quality is maintained at a high value.

At a certain depth of the wellbore, the heated heat transfer fluid in the heat transfer fluid inlet tubing string 112 flashes the hot feedwater into high-quality steam which is directed through the perforations 128 and into the subterranean formation.

After transfer of heat from the heat transfer fluid to the hot feedwater, the cooled transfer fluid is returned to the surface through a cold heat transfer fluid outlet tubing string 114. A layer of insulation 116 may be provided between the heat transfer fluid inlet tubing string 112 and the cold heat transfer fluid outlet tubing string 114. In one embodiment, the concentric tubing string configuration has an outer diameter of between 2.5 and 4.5 inches or more, and in a particular embodiment has an outer diameter of 2.875 inches, but can be larger depending on the size of each concentric tubing string configuration.

In certain embodiments, the heat transfer fluid may be circulated through a closed-loop system. In this regard, a thermal fluid heater 111 located at the surface may be configured to heat a heat transfer fluid to a very high temperature. The thermal fluid heater 111 is configured to operate on any of a variety of energy sources. For example, in one embodiment, the thermal fluid heater 111 operates using combustion of a fuel that may include natural gas, propane, methanol, and biofuel. The thermal fluid heater 111 can also operate on electricity and solar energy.

The heat transfer fluid is heated by the surface thermal fluid heater to a very high temperature. In this regard, the heat transfer fluid should have a very high boiling point. In one embodiment, the heat transfer fluid is molten salt with a high boiling temperature of approximately 1,150° F. Thus, the surface thermal fluid heater heats the heat transfer fluid to a temperature as high as 1,150° F. In other embodiments, synthetic heat transfer fluid is heated to a temperature as high as of 950° F. or another lower temperature. Preferably, the heat transfer fluid is heated to a temperature that is greater than 700° F. to compensate for the thermodynamics of the conversion from hot feedwater to steam. In other embodiments, the heat transfer fluid may be DOWTHERM™, an ethylene glycol-based heat transfer fluid, and SYLTHERM™, a dimethyl polysiloxane-based heat transfer fluid, both by Dow Chemical, THERMINOL®, a polychlorinated biphenyl-based heat transfer fluid, by Eastman Chemical Company, or any synthetic non corrosive heat transfer fluid, for example.

A heat transfer fluid pump (not shown) is preferably positioned on the cold side of the thermal fluid heater. The pump may be sized according to the particular needs of the system as implemented. Additionally, a reserve storage flask on the surface containing additional heat transfer fluid is included in the closed loop to ensure sufficient heat transfer fluid in the downhole system.

In certain embodiments, a surfactant may be used to improve the effectiveness of the heat transfer fluid. Surfactants are compounds that lower the surface tension between a liquid and, for example, a solid (such as the tubing string walls). In this regard, a surfactant-based drag reducing additive is injected in the concentric tubing string of the heat transfer fluid. The surfactant effectively reduces the pressure drop in the heat transfer fluid and increases the flow rate of the heat transfer fluid.

Use of the hot feedwater can cause scale buildup in the downhole heat exchanger arrangement 100. To reduce or remove the scale buildup, an acid scale wash is delivered through a tubing string 160 to the downhole heat exchange system 110. In the illustrated embodiment of FIG. 1, a tubing string 160 is dedicated for the acid scale wash. In other embodiments, the tubing string 160 used for the acid scale wash may also be used for the hot feedwater by, for example, temporarily substituting hot feedwater for the acid scale wash or vice versa. In other embodiments, the tubing string 120 used for the hot feedwater may also be used for the acid scale wash by, for example, temporarily substituting acid scale wash for the hot feedwater. Various materials may be used for the acid scale wash. In one embodiment, the acid scale wash is hydrochloric acid (HCl).

The concentricity of the various tubing strings in the vertical wellbore 130 is illustrated in the cross-sectional view illustrated in FIG. 1 and taken along I-I. In the illustrated embodiment, an acid scale wash is carried through a centermost tubing 160. The hot heat transfer fluid is carried downward through an inner tubing string 112, and the cooled transfer fluid is returned upward through a tubing string 114 outside the inner tubing string 112. A layer of insulation 116 is provided between the two innermost tubing strings to minimize heat loss of the heat transfer from the heated heat transfer fluid to the cooled transfer fluid being returned. Hot feedwater is carried downward through the outermost tubing string 120. In this regard, the hot feedwater may absorb some residual heat from the cooled transfer fluid being returned. As noted above, in the embodiment of FIG. 1, the sucker rod pump 140 or an electrical submersible pump (ESP) 142 are positioned in a non-concentric manner, for example, within a portion of the outermost concentric tubing string or the casing annulus 120.

Figure 2:
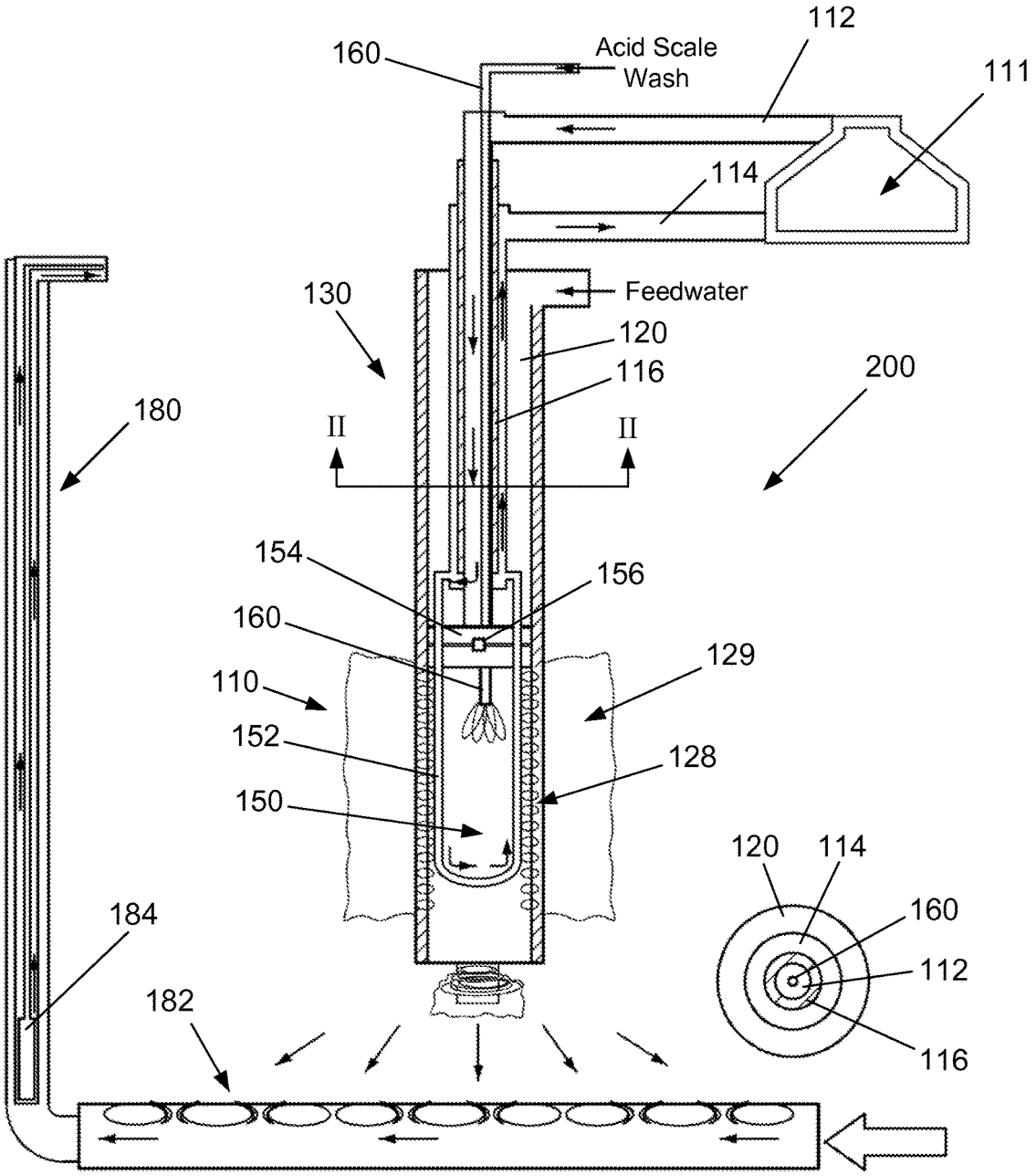
FIG. 2 is a schematic illustration of a combination of a vertical wellbore with a downhole heat exchanger and a horizontal oil recovery wellbore in accordance with an embodiment.

Referring now to FIG. 2, a cross-sectional view of a second embodiment of a downhole heat exchanger arrangement 200 in accordance with an embodiment of the present invention is illustrated. The arrangement 200 of FIG. 2 is similar to the embodiment illustrated in FIG. 1, but with a difference in the way the hydrocarbons are recovered and delivered to the surface.

As with the embodiment of FIG. 1, FIG. 2 illustrates an embodiment in which the downhole heat exchange system 110 is positioned within a vertical wellbore 130. The vertical wellbore 130 includes concentric tubing strings formed to allow various fluids to flow therethrough. Hot feedwater is injected into the vertical wellbore 130 through a third concentric tubing string or the casing annulus 120. The downhole heat exchange system 110 is configured to flash the hot feedwater into steam 129, and the steam is directed into the hydrocarbons in a subsurface subterranean formation through, for example, perforations 128 in the wellbore 130. Steam is directed into the geologic strata around the vertical wellbore 130.

As with the embodiment of FIG. 1, in the embodiment of FIG. 2, a heated heat transfer fluid is delivered through a heat transfer fluid inlet tubing string 112. The heated heat transfer fluid is provided from the surface to a position within the wellbore. The heated heat transfer fluid is pumped through the heat transfer fluid inlet tubing string 112 at a very high flow rate to minimize loss of heat to the hot feedwater.

Hot feedwater is injected into either a separate concentric tubing string of the concentric configuration or the casing annulus 120. In the illustrated embodiment, the hot feedwater tubing string 120 is the casing annulus. The heated heat transfer fluid in the heat transfer fluid inlet tubing string 112 flashes the hot feedwater into high-quality steam 129 which is directed through the perforations 128 and into the subsurface subterranean formation.

At the downhole heat exchanger 110 shown in FIG. 2, inlet tubing string 112 connects to a downhole heat exchanger tubing string 152 within a steam chamber portion 150 of the downhole heat exchanger 110. The heat transfer fluid from the inlet tubing string 112 passes through downhole heat exchanger tubing. Heat from downhole heat exchanger tubing string 152 vaporizes the hot feedwater in the tubing string 120 within steam chamber portion 150. After passing through downhole heat exchanger 110 and the downhole heat exchanger tubing string 152, return heat transfer fluid ascends in the an outlet tubing string 114 to the surface thermal fluid heater for reheating and recirculation of the heated heat transfer fluid.

A packer assembly 154 with a feed valve(s) 156 controls the rate of hot feedwater into downhole heat exchanger 110. In one embodiment, the feed valve(s) 156 responds to the pressure differences between the hot feedwater at the base of the hot feedwater tubing string 120 and the vapor pressure within the steam chamber portion 150 so that vapor quality is maintained at a high value.

After transfer of heat from the heat transfer fluid to the hot feedwater, the cooled transfer fluid is returned to the surface through a cold heat transfer fluid outlet tubing string 114 to the surface thermal fluid heater for reheating and recirculation of the heated heat transfer fluid. A layer of insulation 116 may be provided between the heat transfer fluid inlet tubing string 112 and the cold heat transfer fluid outlet tubing string 114.

In certain embodiments, the heat transfer fluid may be circulated through a closed-loop system. In this regard, a thermal fluid heater 111 may be configured to heat a heat transfer fluid to a high temperature. The thermal fluid heater 111 may be positioned on the surface and is configured to operate on any of a variety of energy sources.

An acid scale wash is delivered through a tubing string 160 to the downhole heat exchange system 110. In the illustrated embodiment of FIG. 2, a tubing string 160 is dedicated for the acid scale wash. In other embodiments, the casing annulus or the outermost concentric tubing string 120 used for the hot feedwater may also be used for the acid scale wash by, for example, temporarily substituting acid scale wash for the hot feedwater.

The concentricity of the various tubing strings in the vertical wellbore 130 is illustrated in the cross-sectional view illustrated in FIG. 2 and taken along II-II. In the illustrated embodiment, an acid scale wash is carried through a centermost tubing string 160. The hot heat transfer fluid is carried downward through an inner tubing string 112, and the cooled transfer fluid is returned upward through a tubing string 114 outside the inner tubing string 112 to the surface thermal fluid heater 111 for reheating and recirculation. A layer of insulation 116 is provided between the two innermost tubing strings to prevent heat transfer from the heated heat transfer fluid to the cooled transfer fluid being returned. Hot feedwater is carried downward through the casing annulus or the outermost concentric tubing string 120.

As noted above, in the embodiment of FIG. 1, the recovered hydrocarbons are delivered to the surface via a sucker rod pump or an electrical submersible pump (ESP) extending within the wellbore 130. In contrast, in the embodiment of FIG. 2, a recovery arrangement includes a separate vertical oil production wellbore 180 and a horizontal oil collection wellbore 182. In this regard, steam adds thermal energy to the hydrocarbons from a subsurface subterranean formation and serves to reduce the viscosity of the hydrocarbons from a subsurface subterranean formation deposit, causing the hydrocarbons from a subsurface subterranean formation to flow downward due to gravity drainage. The downward flowing hydrocarbons (e.g., via gravity drainage) are collected in the horizontal collection wellbore 182. The hydrocarbons are brought to the surface through a vertical oil production wellbore 180, and are transported to one or more tanks (not shown) on the surface. In this regard, an electrical submersible pump (ESP) 184 is provided near the bottom of the vertical oil production wellbore 180. The electrical submersible pump (ESP) 184 and all electrical cabling necessary for operation and control of the pump (ESP) 184 are provided within the vertical oil production wellbore 180. In the illustrated embodiment, the vertical oil production wellbore 180 is separate from the steam generating and injection wellbore 130. In other embodiments, the vertical oil production wellbore 180 may be formed as a part of the steam generating and injection wellbore 130. Of course, those skilled in the art will recognize that there may be one or more horizontal collection wellbores 182 and one or more vertical oil production wellbores 180 for each steam generating wellbore 130. Similarly, there may be a plurality of one or more steam generating wellbores 130 for each horizontal collection wellbore 182 and/or each vertical oil production wellbore 180 for improved steam distribution.

Figure 3:
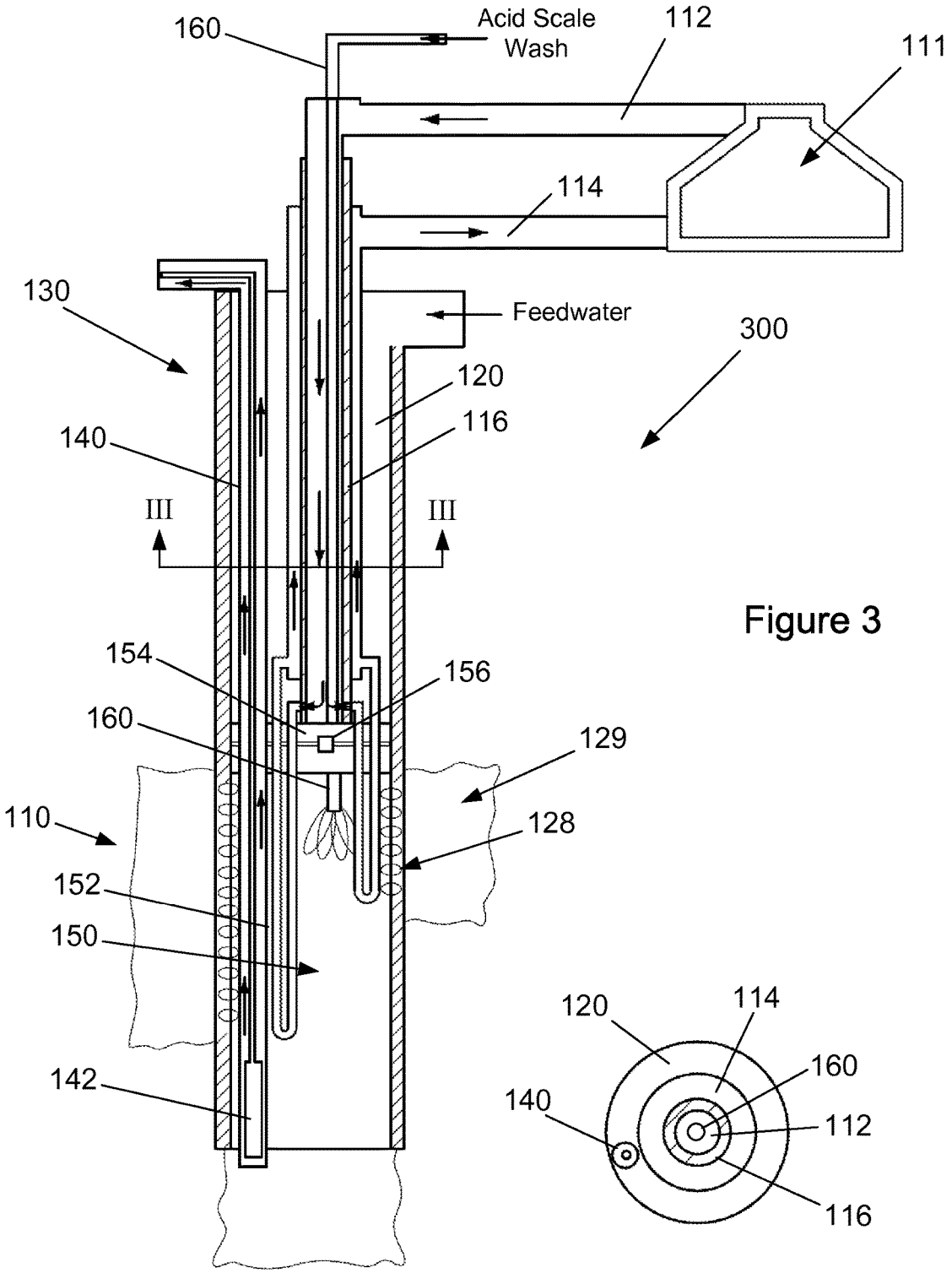
FIG. 3 is a schematic illustration of a vertical wellbore with a downhole heat exchanger in accordance with an embodiment.

Referring now to FIG. 3, a cross-sectional view of an embodiment of a downhole heat exchanger arrangement 300 in accordance with another embodiment of the present invention is illustrated. In accordance with the arrangement 300 of FIG. 3, a downhole heat exchange system 110 is provided to provide heat to the hot feedwater to generate high-quality steam.

In accordance with the embodiment illustrated in FIG. 3, the downhole heat exchange system 110 is positioned within a vertical wellbore 130. The vertical wellbore 130 includes insulated concentric tubing strings formed to allow various fluids to flow therethrough. Hot feedwater is injected into the vertical wellbore 130 downward through the casing annulus or the outermost concentric tubing string 120. The downhole heat exchange system 110 is configured to flash the hot feedwater into steam 129, and the steam is directed into the hydrocarbons in a subsurface subterranean formation through, for example, perforations 128 in the wellbore 130. The perforations 128 are schematically illustrated in FIG. 1 near the bottom of the vertical wellbore 130.

The steam adds thermal energy to the hydrocarbons to reduce the viscosity of the hydrocarbons from a subsurface subterranean formation deposit, causing the hydrocarbons from a subsurface subterranean formation to flow downward due to gravity drainage. The hydrocarbons from the subsurface subterranean formation flowing downward via gravity drainage are captured in a horizontal production wellbore (e.g., wellbore 182 of FIG. 4) and brought to the surface through a sucker rod pump 140 or an electrical submersible pump (ESP) 142 and are transported to one or more tanks (not shown) on the surface. In this regard, an electrical submersible pump (ESP) 142 is provided at a point sufficiently deep to capture the flowing hydrocarbons. The electrical submersible pump (ESP) 142 and all electrical cabling necessary for operation and control of the electrical submersible pump (ESP) 142 are provided within a wellbore. In the illustrated embodiment, the tubing string forming the sucker rod pump 140 is not concentric with the other tubing strings in the downhole heat exchanger arrangement 100. Of course, those skilled in the art will recognize that the sucker rod pump 140 or an electrical submersible pump (ESP) 142 may be positioned differently in different embodiments.

Referring again to FIG. 3, a heated heat transfer fluid is delivered through a heat transfer fluid inlet tubing string 112. The heated heat transfer fluid is provided from the surface to a position within the wellbore. The heated heat transfer fluid is pumped through the heat transfer fluid inlet tubing string 112 at a very high flow rate to minimize loss of heat to the hot feedwater.

Additionally, hot feedwater is injected into a the casing annulus 120 or the outermost tubing string of the concentric configuration. The hot feedwater may be injected at a superheated temperature to maximize the thermal energy delivered to the hydrocarbons in the subsurface subterranean formation. In the illustrated embodiment, the hot feedwater descends down the casing annulus 120 or the hot feedwater can descend in the outermost tubing string in the concentric tubing configuration.

At the downhole heat exchanger 110 shown in FIG. 3, inlet tubing string 112 connects to a downhole heat exchanger tubing string 152 within a steam chamber portion 150 of the downhole heat exchanger 110. The heat transfer fluid from the inlet tubing string 112 passes through downhole heat exchanger tubing. Heat from downhole heat exchanger tubing string 152 vaporizes the hot feedwater in casing annulus or the outermost concentric tubing string 120 within steam chamber portion 150. After passing through downhole heat exchanger 110 and the downhole heat exchanger tubing string 152, return heat transfer fluid ascends in the an outlet tubing string 114 to the surface thermal fluid heater for reheating and recirculation of the heated heat transfer fluid.

In contrast to the downhole heat exchanger tubing string illustrated in FIG. 1, the downhole heat exchanger tubing string in FIG. 3 comprises multiple branches for more efficient transfer of heat to the hot feedwater. For example, as illustrated in FIG. 3, the different branches of the downhole heat exchanger tubing string may extend to different depths of a thick formation, thus providing simultaneous thermal energy via high-quality steam to a larger range of depths of the subterranean formation. In other examples, the different branches of the downhole heat exchanger tubing may extend to separate formations to simultaneously deliver thermal energy to each of the separate formations.

Referring again to FIG. 3, similar to the embodiment of FIG. 1, a packer assembly 154 with a feed valve(s) 156 controls the rate of hot feedwater into downhole heat exchanger 110. In one embodiment, the feed valve(s) 156 responds to the pressure differences between the hot feedwater at the base of the hot feedwater casing annulus or the outermost concentric tubing string 120 and the vapor pressure within the steam chamber portion 150 so that vapor quality is maintained at a high value.

After transfer of heat from the heat transfer fluid to the hot feedwater, the cooled transfer fluid is returned to the surface through a cold heat transfer fluid outlet tubing string 114 to the surface thermal fluid heater for reheating and recirculation of the heated heat transfer fluid. A layer of insulation 116 may be provided between the heat transfer fluid inlet tubing string 112 and the cold heat transfer fluid outlet tubing string 114.

An acid scale wash is delivered through a tubing string 160 to the downhole heat exchange system 110. In the illustrated embodiment of FIG. 3, a tubing string 160 is dedicated for the acid scale wash. In other embodiments, the casing annulus or the outermost concentric tubing string 120 used for the hot feedwater may also be used for the acid scale wash by, for example, temporarily substituting acid scale wash for the hot feedwater.

The concentricity of the various tubing strings in the vertical wellbore 130 is illustrated in the cross-sectional view illustrated in FIG. 3 and taken along III-III. In the illustrated embodiment, an acid scale wash is carried through a centermost tubing string 160. The hot heat transfer fluid is carried downward through an inner tubing string 112, and the cooled transfer fluid is returned upward through a tubing string 114 outside the inner tubing string 112. A layer of insulation 116 is provided between the two innermost tubing strings to prevent heat transfer from the heated heat transfer fluid to the cooled transfer fluid being returned. Hot feedwater is carried downward through the casing annulus 120. As noted above, in the embodiment of FIG. 3, the sucker rod pump 140 or an electrical submersible pump (ESP) 142 is positioned in a non-concentric manner, for example, within a portion of the outermost concentric tubing string or casing annulus 120.

Figure 4:
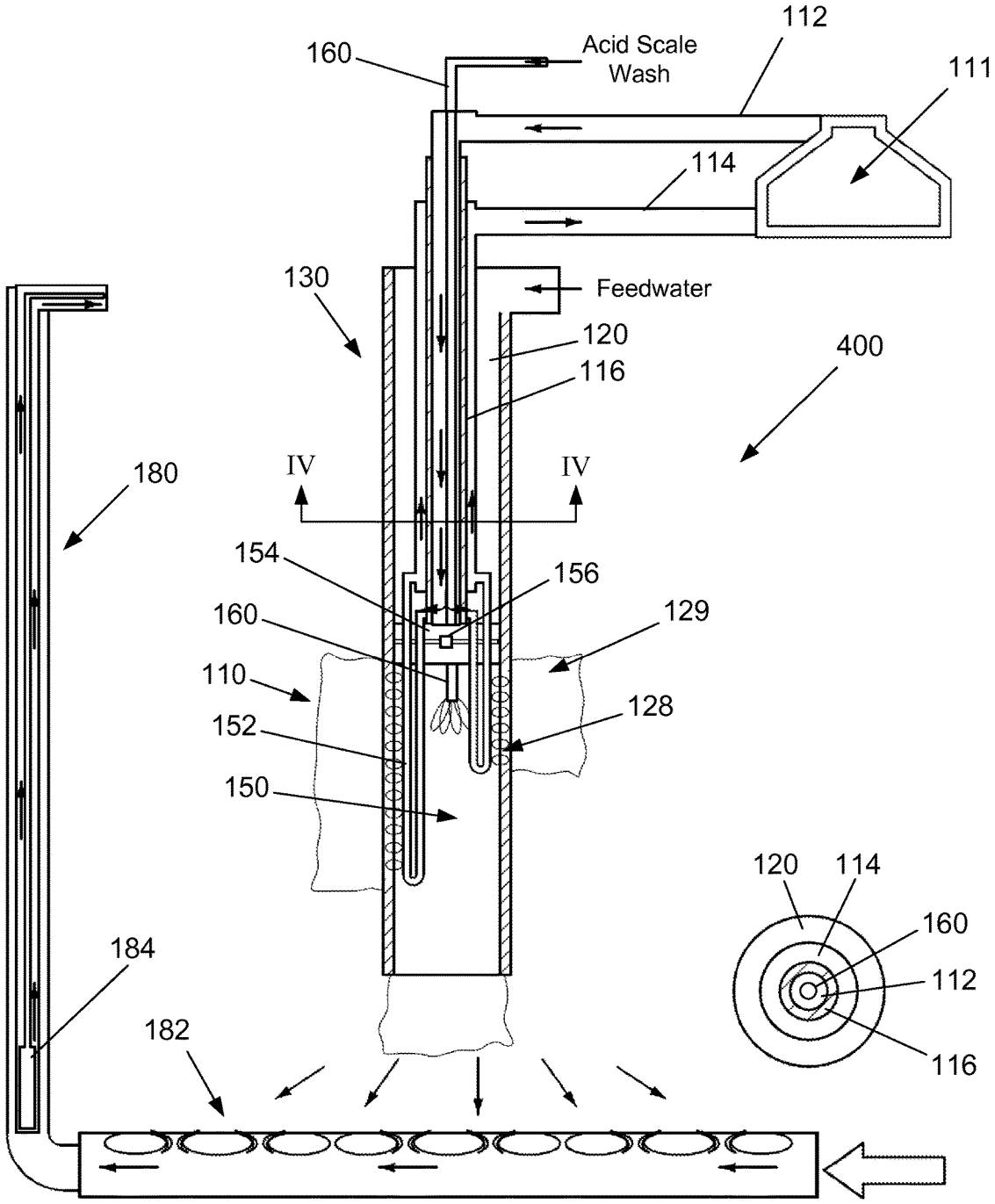
FIG. 4 is a schematic illustration of a combination of a vertical wellbore with a downhole heat exchanger and a horizontal oil recovery wellbore in accordance with an embodiment.

Referring now to FIG. 4, a cross-sectional view of another embodiment of a downhole heat exchanger arrangement 200 in accordance with an embodiment of the present invention is illustrated. The arrangement 400 of FIG. 4 is similar to the embodiment illustrated in FIG. 3, but with a difference in the way the hydrocarbons are recovered and delivered to the surface.

As with the embodiment of FIG. 3, FIG. 4 illustrates an embodiment in which the downhole heat exchange system 110 is positioned within a vertical wellbore 130. The vertical wellbore 130 includes concentric tubing strings formed to allow various fluids to flow therethrough. Hot feedwater is injected into the vertical wellbore 130 through a concentric tubing string or casing annulus 120. The downhole heat exchange system 110 is configured to flash the hot feedwater into steam 129, and the steam is directed into the hydrocarbons in a subsurface subterranean formation through, for example, perforations 128 in the wellbore 130. Steam is directed into the geologic subterranean formation around the vertical wellbore 130.

As with the embodiments of FIGS. 1-3, in the embodiment of FIG. 4, a heated heat transfer fluid is delivered through a heat transfer fluid inlet tubing string 112. The heated heat transfer fluid is provided from the surface to a position within the wellbore. The heated heat transfer fluid is pumped through the heat transfer fluid inlet tubing string 112 at a very high flow rate to minimize loss of heat to the hot feedwater.

Hot feedwater is injected into a separate concentric tubing string or casing annulus 120 of the concentric configuration. In the illustrated embodiment, the hot feedwater descends down the casing annulus 120 or the outermost tubing string in the concentric configuration. The heated heat transfer fluid in the heat transfer fluid inlet tubing string 112 flashes the hot feedwater into high-quality steam 129 which is directed through the perforations 128 and into the subsurface subterranean formation.

At the downhole heat exchanger 110 shown in FIG. 4, inlet tubing string 112 connects to a downhole heat exchanger tubing string 152 within a steam chamber portion 150 of the downhole heat exchanger 110. The heat transfer fluid from the inlet tubing string 112 passes through downhole heat exchanger tubing. Heat from downhole heat exchanger tubing string 152 vaporizes the hot feedwater in tubing 120 within steam chamber portion 150. After passing through downhole heat exchanger 110 and the downhole heat exchanger tubing string 152, return heat transfer fluid ascends in the an outlet tubing string 114 to the surface thermal fluid heater for reheating and recirculation of the heated heat transfer fluid.

In contrast to the downhole heat exchanger tubing string illustrated in FIGS. 1 and 2 and similar to the downhole heat exchanger tubing string of FIG. 3, the downhole heat exchanger tubing string in FIG. 4 comprises multiple branches for more efficient transfer of heat to the hot feedwater. For example, as illustrated in FIG. 3, the different branches of the downhole heat exchanger tubing string may extend to different depths, thus providing high-quality steam to a larger range of depths of the subterranean formation.

A packer assembly 154 with a feed valve(s) 156 controls the rate of hot feedwater into downhole heat exchanger 110. In one embodiment, the feed valve(s) 156 responds to the pressure differences between the hot feedwater at the base of the hot feedwater casing annulus 120 and the vapor pressure within the steam chamber portion 150 so that vapor quality is maintained at a high value.

After transfer of heat from the heat transfer fluid to the hot feedwater, the cooled transfer fluid is returned to the surface through a cold heat transfer fluid outlet tubing string 114. A layer of insulation 116 may be provided between the heat transfer fluid inlet tubing string 112 and the cold heat transfer fluid outlet tubing string 114.

An acid scale wash is delivered through a tubing string 160 to the downhole heat exchange system 110. In the illustrated embodiment of FIG. 4, a tubing string 160 is dedicated for the acid scale wash. In other embodiments, the casing annulus 120 used for the hot feedwater may also be used for the acid scale wash by, for example, temporarily substituting acid scale wash for the hot feedwater.

The concentricity of the various tubing strings in the vertical wellbore 130 is illustrated in the cross-sectional view illustrated in FIG. 4 and taken along IV-IV. In the illustrated embodiment, an acid scale wash is carried through a centermost tubing string 160. The hot heat transfer fluid is carried downward through an inner tubing string 112, and the cooled transfer fluid is returned upward through a tubing string 114 outside the inner tubing string 112. A layer of insulation 116 is provided between the two innermost tubing strings to prevent heat transfer from the heated heat transfer fluid to the cooled transfer fluid being returned. Hot Feedwater is carried downward through the outermost concentric tubing string or casing annulus 120.

Similar to the embodiment of FIG. 2, the embodiment illustrated in FIG. 4 includes a recovery arrangement with a separate vertical oil production wellbore 180 and a horizontal collection wellbore 182. The hydrocarbons flowing downward via gravity drainage are collected in the horizontal collection wellbore 182. The hydrocarbons are brought to the surface through a vertical oil production wellbore 180, and are transported to one or more tanks (not shown) on the surface. In this regard, an electrical submersible pump (ESP) 184 is provided near the bottom of the vertical oil production wellbore 180. The electrical submersible pump (ESP) 184 and all electrical cabling necessary for operation and control of the electrical submersible pump (ESP) 184 are provided within the vertical oil production wellbore 180. In the illustrated embodiment, the vertical oil production wellbore 180 is separate from the steam injection wellbore 130. In other embodiments, the vertical oil production wellbore 180 may be formed as a part of the steam injection wellbore 130. As noted above, those skilled in the art will recognize that there may be one or more collection horizontal wellbores 182 and one or more vertical oil production wellbores 180 for each steam generating wellbore 130. Similarly, there may be a plurality of one or more steam generating wellbores 130 for each horizontal collection wellbore 182 or each vertical oil production wellbore 180 for improved steam distribution. For example, one or more vertical downhole steam generating wellbores may be provided for one or more horizontal production wellbore to improve distribution of steam over the subterranean formation.

Figure 5:
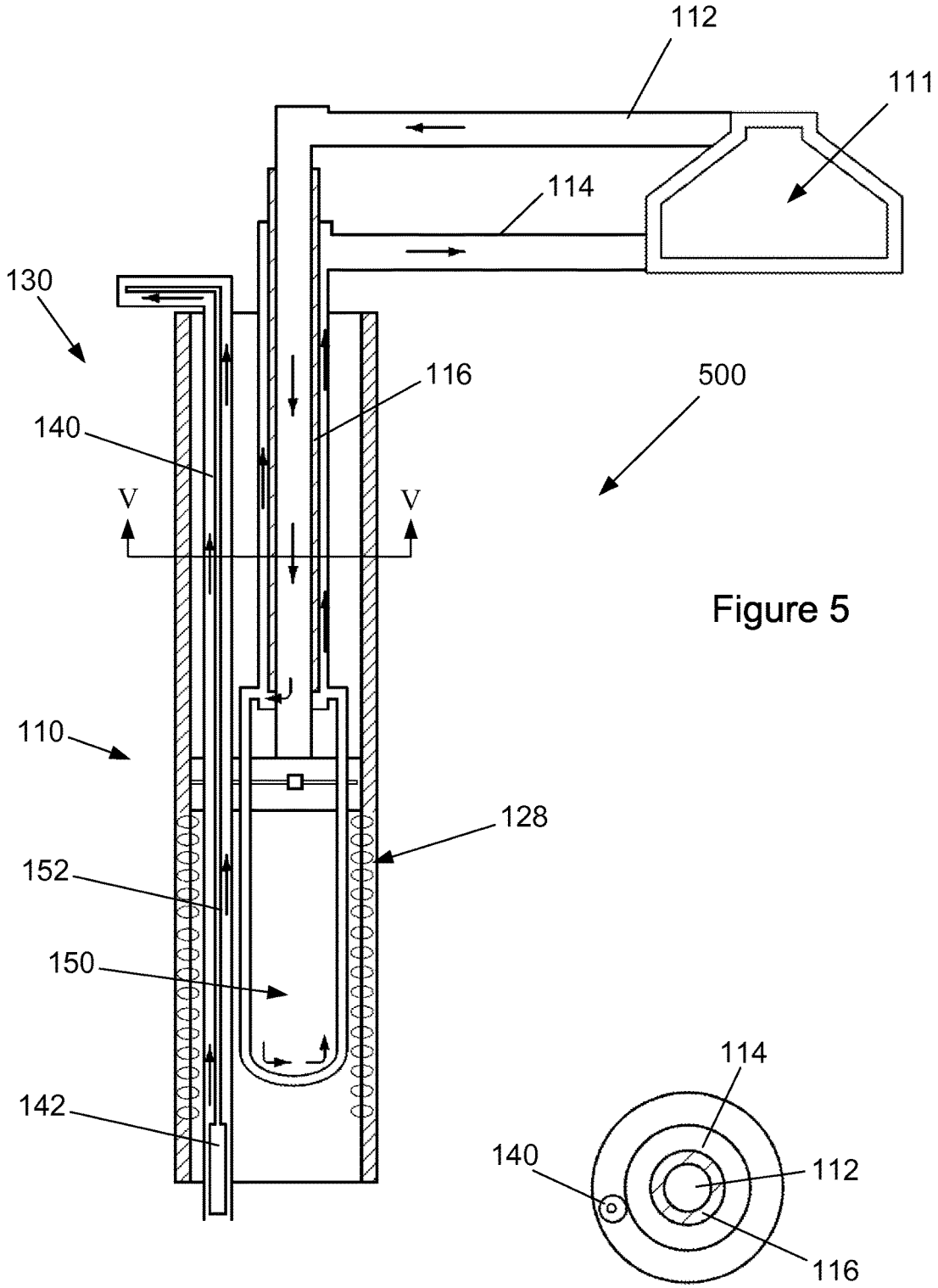
FIG. 5 is a schematic illustration of a vertical wellbore with a downhole heat exchanger in accordance with an embodiment.

Referring now to FIG. 5, a cross-sectional view of an embodiment of a downhole heat exchanger arrangement 500 in accordance with another embodiment of the present invention is illustrated. In accordance with the arrangement 500 of FIG. 5, a downhole heat exchange system 110 is provided to provide heat to the surrounding subsurface subterranean formation. Contrary to the embodiments of FIGS. 1-4, the embodiment of FIG. 5 does not use hot feedwater to generate steam. As described below, the heat exchange system 110 provides heat to the subsurface subterranean formation to directly heat the subterranean formation and/or to provide heat to water already in the subsurface environment to generate steam.

In accordance with the embodiment illustrated in FIG. 5, the downhole heat exchange system 110 is positioned within a vertical wellbore 130. The vertical wellbore 130 includes concentric tubing strings formed to allow various fluids to flow therethrough.

The downhole heat exchange system 110 includes a series of perforations 128 in the vertical wellbore 130 to transfer heat to the subterranean formation outside the wellbore 130. The transfer of conductive or convective heat from the heat exchange system to the subterranean formation adds thermal energy to the hydrocarbons in the subsurface subterranean formation and serves to reduce the viscosity of the hydrocarbons from a subsurface subterranean formation deposit, causing the hydrocarbons from the subsurface subterranean formation to flow downward due to gravity drainage. The hydrocarbons from the subsurface subterranean formation are captured in a horizontal production wellbore (e.g., wellbore 182 of FIGS. 2 and 4) and brought to the surface through a sucker rod pump 140 or an electrical submersible pump (ESP) 142 and are transported to one or more tanks (not shown) on the surface. In this regard, a sucker rod pump 140 or an electrical submersible pump (ESP) 142 is provided at a point sufficiently deep to capture the flowing hydrocarbons. The electrical submersible pump (ESP) 142 and all electrical cabling necessary for operation and control of electrical submersible pump (ESP) 142 are provided within a tubing string in the vertical wellbore that may include a sucker rod pump 140. In the illustrated embodiment, the electrical submersible pump (ESP) 142 or the sucker rod pump 140 are not concentric with the other tubing strings in the downhole heat exchanger arrangement 100. Of course, those skilled in the art will recognize that the sucker rod pump 140 and the electrical submersible pump (ESP) 142 may be positioned differently in different embodiments.

Referring again to FIG. 5, a heated heat transfer fluid is delivered through a heat transfer fluid inlet tubing string 112. The heated heat transfer fluid is provided from the surface to a position within the wellbore. The heated heat transfer fluid is pumped through the heat transfer fluid inlet tubing string 112 at a very high flow rate to minimize loss of heat.

At the downhole heat exchanger 110 shown in FIG. 5, inlet tubing string 112 connects to a downhole heat exchanger tubing string 152 within a chamber portion 150 of the downhole heat exchanger 110. The heat transfer fluid from the inlet tubing string 112 passes through downhole heat exchanger tubing. The downhole heat exchanger tubing string 152 transfers heat from the heat transfer fluid through the perforations 128 into the surrounding subterranean formation. The heat transferred to the subterranean formation causes substantial heat of the hydrocarbons directly by the heat through conduction and/or by generating steam from water already in the subterranean formation. After passing through downhole heat exchanger 110 and the downhole heat exchanger tubing string 152, return heat transfer fluid ascends in the an outlet tubing string 114.

After transfer of heat from the heat transfer fluid to the surrounding subterranean formation, the cooled transfer fluid is returned to the surface through a cold heat transfer fluid outlet tubing string 114. A layer of insulation 116 may be provided between the heat transfer fluid inlet tubing string 112 and the cold heat transfer fluid outlet tubing string 114.

Since no hot feedwater or steam is used in the embodiment of FIG. 5, there is no need for an acid scale wash.

The concentricity of the various tubing strings in the vertical wellbore 130 is illustrated in the cross-sectional view illustrated in FIG. 5 and taken along V-V. In the illustrated embodiment, the hot heat transfer fluid is carried downward through an inner tubing string 112, and the cooled transfer fluid is returned upward through a tubing string 114 outside the inner tubing string 112. A layer of insulation 116 is provided between the two innermost tubing strings to prevent heat transfer from the heated heat transfer fluid to the cooled transfer fluid being returned.

Figure 6:
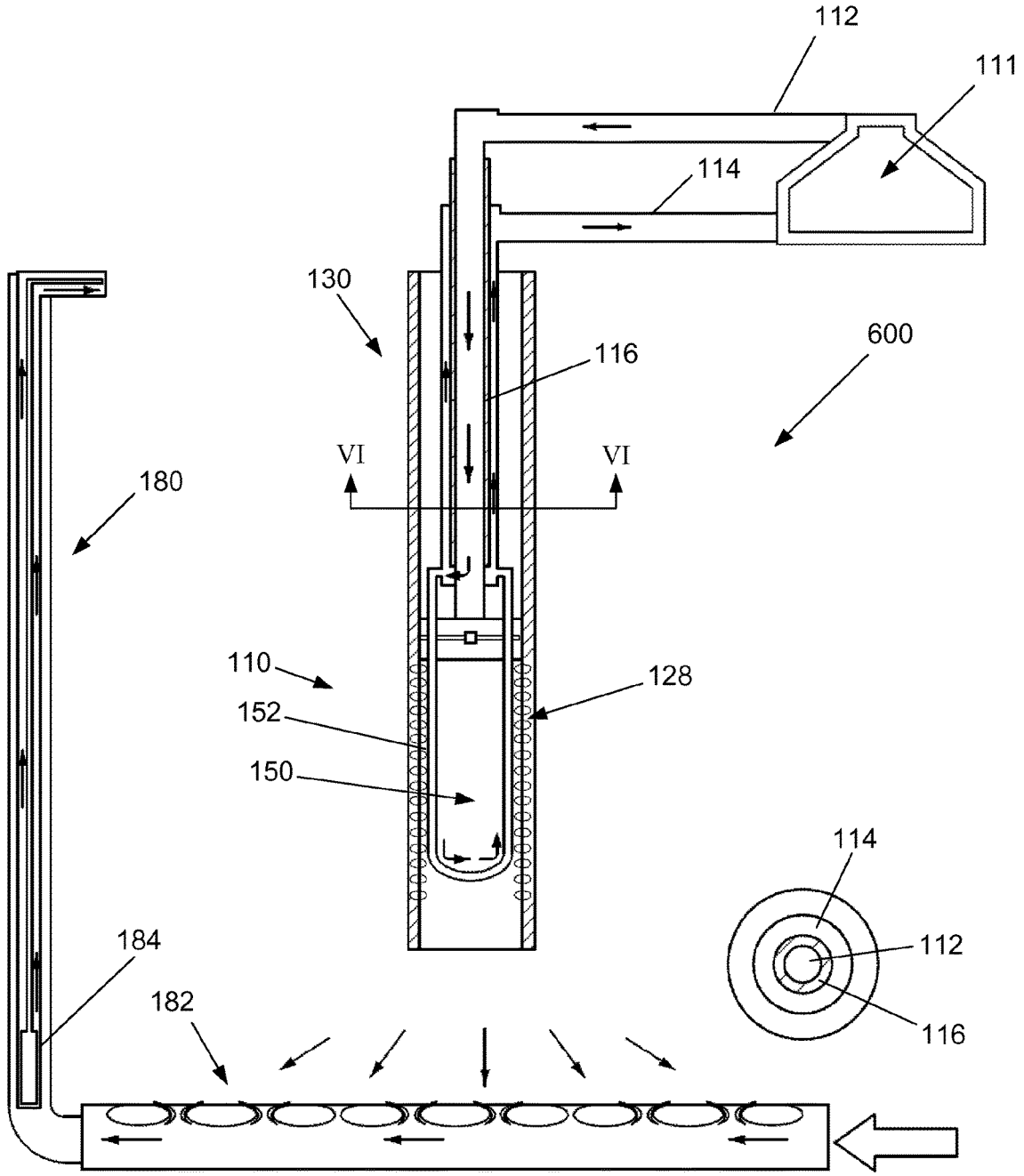
FIG. 6 is a schematic illustration of a combination of a vertical wellbore with a downhole heat exchanger and a horizontal oil recovery wellbore in accordance with an embodiment.

Referring now to FIG. 6, a cross-sectional view of another embodiment of a downhole heat exchanger arrangement 600 in accordance with an embodiment of the present invention is illustrated. The arrangement 600 of FIG. 6 is similar to the embodiment illustrated in FIG. 5, but with a difference in the way the hydrocarbons are recovered and delivered to the surface. Further, contrary to the embodiments of FIGS. 1-4 and similar to the embodiment of FIG. 5, the embodiment of FIG. 6 does not use hot feedwater to generate steam, but instead provides conductive or convective heat to the subsurface subterranean formation to directly heat the subterranean formation and/or to provide heat to water already in the subsurface environment to generate steam in the subterranean formation.

As with the embodiment of FIG. 5, FIG. 6 illustrates an embodiment in which the downhole heat exchange system 110 is positioned within a vertical wellbore 130. The vertical wellbore 130 includes concentric tubing strings formed to allow various fluids to flow therethrough. The downhole heat exchange system 110 includes a series of perforations 128 in the vertical wellbore 130 to transfer heat to the subterranean formation outside the vertical wellbore 130. The transfer of heat from the heat exchange system to the subterranean formation adds thermal energy to the hydrocarbons in the subsurface subterranean formation and serves to reduce the viscosity of the hydrocarbons from a subsurface subterranean formation deposit, causing the hydrocarbons from the subsurface subterranean formation to flow downward due to gravity drainage.

As with the embodiments of FIGS. 1-3, in the embodiment of FIG. 4, a heated heat transfer fluid is delivered through a heat transfer fluid inlet tubing string 112. The heated heat transfer fluid is provided from the surface to a position within the wellbore. The heated heat transfer fluid is pumped through the heat transfer fluid inlet tubing string 112 at a very high flow rate to minimize loss of heat in the wellbore.

At the downhole heat exchanger 110 shown in FIG. 6, inlet tubing string 112 connects to a downhole heat exchanger tubing string 152 within a chamber portion 150 of the downhole heat exchanger 110. The heat transfer fluid from the inlet tubing string 112 passes through downhole heat exchanger tubing. The downhole heat exchanger tubing string 152 transfers heat from the heat transfer fluid through the perforations 128 to the surrounding subterranean formation. The heat transferred to the subterranean formation causes substantial heat of the hydrocarbons directly by the conductive or convective heat and/or by generating steam from water already in the subterranean formation. After passing through downhole heat exchanger 110 and the downhole heat exchanger tubing string 152, return heat transfer fluid ascends in the an outlet tubing string 114 to the surface thermal fluid heater for reheating and recirculation of the heated heat transfer fluid.

After transfer of heat from the heat transfer fluid to the hot feedwater, the cooled transfer fluid is returned to the surface through a cold heat transfer fluid outlet tubing string 114 to the surface thermal fluid heater for reheating and recirculation of the heated heat transfer fluid. A layer of insulation 116 may be provided between the heat transfer fluid inlet tubing string 112 and the cold heat transfer fluid outlet tubing string 114.

Since no hot feedwater is used and steam is not created in the embodiment of FIG. 6, there is no need for an acid scale wash.

The concentricity of the various tubing strings in the vertical wellbore 130 is illustrated in the cross-sectional view illustrated in FIG. 6 and taken along VI-VI. In the illustrated embodiment, the hot heat transfer fluid is carried downward through an inner tubing string 112, and the cooled transfer fluid is returned upward through a tubing string 114 outside the inner tubing string 112. A layer of insulation 116 is provided between the two innermost tubing strings to prevent heat transfer from the heated heat transfer fluid to the cooled transfer fluid being returned.

Similar to the embodiments of FIGS. 2 and 4, the embodiment illustrated in FIG. 6 include a recovery arrangement with a separate vertical tubing string 180 and a horizontal collection bore 182. The hydrocarbons flowing downward via gravity drainage are collected in the horizontal collection wellbore 182. The hydrocarbons are brought to the surface through a vertical oil production wellbore 180, and are transported to one or more tanks (not shown) on the surface. In this regard, an electrical submersible pump (ESP) 184 is provided near the bottom of the vertical oil production wellbore 180. The electrical submersible pump (ESP) 184 and all electrical cabling necessary for operation and control of the electrical submersible pump (ESP) 184 are provided within the vertical oil production wellbore 180. In the illustrated embodiment, the vertical oil production wellbore 180 is separate from the wellbore 130. In other embodiments, the vertical oil production wellbore 180 may be formed as a part of the wellbore 130. As noted above, those skilled in the art will recognize that there may be one or more horizontal collection wellbores 182 and one or more vertical oil production wellbore 180 for each steam generating wellbore 130. Similarly, there may be a plurality of one or more steam generating wellbores 130 overlying each horizontal collection wellbore 182 or each vertical oil production wellbore 180 for improved steam distribution.

In some examples, the thermal energy delivery arrangements described above may be used in conjunction with fracking methods of oil production. For example, downhole steam generation may be used to allow injection of high-pressure high quality steam to facilitate fracking of subterranean formations. The injection of high-pressure high quality steam may result in the propagation of fractures in the formation or the rock layer. Steam fracking is a technique used to fracture the rock layer directly adjacent to the oil and gas well to substantially enhance hydrocarbon recovery. Steam fracking eliminates potential environmental impacts, including contamination of ground water, risks to air quality, the migration of gases and hydraulic fracturing chemicals to the ground water, the surface, surface contamination from spills and the health effects of these. Steam fracking point to the vast amount of low-volume produced viscous heavy oil, low-permeability diatomite, shale oil, tight oil, shale gas and coal bed methane. Steam fracking is environmentally safe and will satisfy the environmentalists and does not jeopardize the health of inhabitants.

The heat transfer fluid is heated by the thermal fluid heater to a very high temperature. In this regard, the heat transfer fluid should have a very high boiling point. In one embodiment, the heat transfer fluid is molten salt with a boiling temperature of approximately 1,150° F. Thus, the thermal fluid heater heats the heat transfer fluid to a temperature as high as 1,150° F. In other embodiments, the synthetic non-corrosive heat transfer fluid is heated to a temperature of about 950° F. or another temperature. Preferably, the heat transfer fluid is heated to a temperature that is greater than 700° F. The heat transfer fluid deemed appropriate by those skilled in the art that may be injected into the wellbore such as diesel oil, gas oil, molten sodium, and synthetic heat transfer fluids, e.g., THERMINOL™ 59 heat transfer fluid which is commercially available from Solutia, Inc., MARLOTHERM™ heat transfer fluid which is commercially available from Condea Vista Co., SYLTHERM™ and DOWTHERM™ heat transfer fluids which are commercially available from The Dow Chemical Company.

Thus, embodiments described herein generally relate to systems, methods, and thermal fluid heaters for treating a subsurface subterranean formation. Embodiments described herein also generally relate to thermal fluid heaters that have novel components therein. Such thermal fluid heaters can be obtained by using the systems and methods described herein.

In certain embodiments, the invention provides one or more systems, methods, and/or heater. In some embodiments, the systems, methods, and/or heater are used for treating a subsurface subterranean formation.

In some embodiments, an In Situ heat treatment system for producing hydrocarbons from a subsurface subterranean formation includes a plurality of wellbores in the subterranean formation; piping positioned in at least two of the wellbores; a fluid circulation system coupled to the piping; and a heat supply configured to heat a heat transfer fluid continually circulated through the piping to heat the temperature of the subterranean formation to temperatures that allow for hydrocarbon production from the subterranean formation.

In some embodiments, a method of heating a subsurface subterranean formation includes heating a heat transfer fluid using heat exchange with a heat supply; continually circulating the heat transfer fluid through piping in the subterranean formation to heat a portion of the subterranean formation to allow hydrocarbons to be produced from the subterranean formation; and producing hydrocarbons from the subterranean formation.

In some embodiments, a method of heating a subsurface subterranean formation includes passing a heat transfer fluid from a surface thermal fluid heater to a downhole heat exchanger; heating the heat transfer fluid to a first temperature; flowing the heat transfer fluid through a heater section to a sump, wherein heat transfers from the heater section to a treatment area in the subterranean formation; gas lifting the heat transfer fluid to the surface from the sump; and returning at least a portion of the heat transfer fluid to the vessel.

In further embodiments, features from specific embodiments may be combined with features from other embodiments. For example, features from one embodiment may be combined with features from any of the other embodiments.

In further embodiments, treating a subsurface subterranean formation is performed using any of the methods, systems, or heater described herein.

In further embodiments, additional features may be added to the specific embodiments described herein.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

What is claimed is:

1. A method, comprising:

heating a heat transfer fluid;

continuously circulating the heated heat transfer fluid into a vertical wellbore to a downhole heat exchanger positioned in a steam chamber of the vertical wellbore via tubing;

advancing heated feedwater into the vertical wellbore to the downhole heat exchanger in concentricity with the tubing carrying the heated heat transfer fluid to further heat the heated feedwater flowing downward in the vertical wellbore above a packer assembly, the packer assembly being provided in a downhole position of the vertical wellbore above the downhole heat exchanger, wherein the downhole heat exchanger is configured to transfer heat from the heated heat transfer fluid to the heated feedwater to generate steam and return the heated heat transfer fluid via the continuous circulation from the downhole heat exchanger for reheating;

controllably feeding the heated feedwater below the packer assembly via a feed valve provided by the packer assembly, wherein the heated feedwater flashes into steam below the packer assembly via the heat transfer from the heat exchanger;

transmitting the steam from the downhole heat exchanger into a subterranean formation, whereby thermal energy from the steam causes a reduction in viscosity of hydrocarbons in the subterranean formation;

injecting, via an acid wash line that is separate from the tubing, an acid scale wash to counter scale buildup on the downhole heat exchanger from the heated feedwater;

returning the heated heat transfer fluid from the downhole heat exchanger via the continuous circulation to a surface thermal fluid heater;

recovering liquefied oil deposits from the hydrocarbons in the subterranean formation in a horizontal wellbore; and transmitting the recovered liquefied oil deposits to above ground through a production line.

2. The method of claim 1, wherein the heat transfer fluid comprises one or more of the following: diesel oil, gas oil, molten sodium, or a synthetic heat transfer fluid.

3. The method of claim 1, wherein the acid scale wash is hydrochloric acid.

4. The method of claim 1, further comprising:

recovering liquefied hydrocarbons using an electrical submersible pump (ESP) or sucker rod including a sump pump positioned adjacent the bottom of the vertical wellbore.

5. The method of claim 1, wherein recovering the liquefied oil deposits from the hydrocarbons in the subterranean formation in the horizontal wellbore is via an electrical submersible pump (ESP) or a sucker rod positioned adjacent a bottom of another vertical wellbore that the horizontal wellbore extends therefrom.

6. The method of claim 1, wherein the heat transfer fluid is heated to at least 700° F.

7. The method of claim 1, wherein the heat transfer fluid is molten salt or a synthetic non corrosive heat transfer fluid.

8. The method of claim 1, wherein the vertical wellbore includes concentric tubing strings for flow of heated heat transfer fluid, the cooled heat transfer fluid and the heated feedwater.

9. The method of claim 1, wherein the heated feedwater is at a super critical temperature before being converted into steam.

10. The method of claim 1, wherein the heated feedwater is advanced into the vertical wellbore at a superheated temperature.

11. The method of claim 1, wherein the heated feedwater is at a super critical temperature before being converted into steam, and wherein the heated feedwater is advancing in the vertical wellbore to the downhole heat exchanger via a casing annulus or a separate outermost concentric tubing string.

12. A system, comprising:

a vertical wellbore;

a downhole heat exchanger positioned at a downhole position of the vertical wellbore;

a packer assembly provided in a downhole position of the vertical wellbore above the downhole heat exchanger;

a heat transfer fluid loop system having tubing for continuously circulating heated heat transfer fluid into the vertical wellbore to the downhole heat exchanger;

a feedwater system to provide heated feedwater into the vertical wellbore to the downhole heat exchanger and in concentricity with the tubing that carries the heated heat transfer fluid to further heat the heated feedwater that flows downward in the vertical wellbore above the packer assembly;

a feed valve provided by the packer assembly to controllably feed the heated feedwater below the packer assembly; and an acid scale wash system that has an acid wash line separate from the tubing to inject an acid scale wash to counteract scale buildup from the heated feedwater;

wherein the downhole heat exchanger is configured to transfer heat from the heated heat transfer fluid to the heated feedwater to generate steam below the packer assembly;

wherein the steam is transmitted from the downhole heat exchanger into a subterranean formation, whereby thermal energy from the steam causes a reduction in viscosity of hydrocarbons in the subterranean formation;

wherein the heat transfer fluid loop system is configured to return the heated heat transfer fluid from the downhole heat exchanger to a surface thermal fluid heater;

recovering liquefied oil deposits from the hydrocarbons in the subterranean formation in a horizontal wellbore; and transmitting the recovered liquefied oil deposits to above ground through a production line.

13. The system of claim 12, wherein the production line is provided in the vertical wellbore which is connected to the horizontal wellbore.

14. The system of claim 12, further comprising:

an electrical submersible pump (ESP) or a sucker rod configured to recover the liquefied hydrocarbons positioned adjacent the bottom of the vertical wellbore.

15. The system of claim 14, wherein the system comprises the sucker rod and the sucker rod extends within the vertical wellbore.

16. The method of claim 12, wherein the feedwater system provides the heated feedwater into the vertical wellbore at a superheated temperature.

17. The system of claim 12 wherein the feedwater system provides the heated feedwater into the vertical wellbore to the downhole heat exchanger such that the heated feedwater is at a super critical temperature before being converted into steam.

* * * * *